US005782367A

United States Patent [19]

Aumasson

[11] Patent Number: 5,782,367

[45] Date of Patent: Jul. 21, 1998

[54] DEVICE FOR HOLDING COATHANGERS IN AN ITEM OF LUGGAGE AND ITEM OF LUGGAGE EQUIPPED WITH SUCH A DEVICE

[75] Inventor: Michel Aumasson, Rueil Malmaison, France

[73] Assignee: Delsey, France

[21] Appl. No.: 616,909

[22] Filed: Mar. 19, 1996

[30] Foreign Application Priority Data

Mar. 20, 1995 [FR] France ..... 95 03188

[51] Int. Cl.[6] ..... A47F 7/24

[52] U.S. Cl. ..... 211/124; 211/89; 211/113; 206/279; 206/290

[58] Field of Search ..... 211/124, 89, 94; 248/316.5, 316.6; 206/279, 286, 289, 290, 291, 293; 190/13 R, 100

[56] References Cited

U.S. PATENT DOCUMENTS

| | | | |
|---|---|---|---|
| 3,542,170 | 11/1970 | Bialo | 211/94 X |
| 3,883,003 | 5/1975 | Samhammer et al. | 211/113 |
| 4,193,482 | 3/1980 | Koff | 206/290 X |
| 4,732,270 | 3/1988 | Myers et al. | 211/124 X |
| 4,736,854 | 4/1988 | King et al. | 211/89 |
| 4,753,342 | 6/1988 | Pulichino, Jr. et al. | 206/291 |
| 4,782,947 | 11/1988 | Sheiman | 206/290 X |
| 5,180,057 | 1/1993 | Franklin | 211/89 X |

FOREIGN PATENT DOCUMENTS

| | | |
|---|---|---|
| 0 290 298 A1 | 11/1988 | European Pat. Off. . |
| 0 331 153 A1 | 9/1989 | European Pat. Off. . |
| 770 333 | 9/1934 | France . |
| 678 115 | 8/1952 | United Kingdom . |

*Primary Examiner*—Ramon O. Ramirez
*Assistant Examiner*—Long Dinh Phan
*Attorney, Agent, or Firm*—Finnegan, Henderson, Farabow, Garrett & Dunner, L.L.P.

[57] ABSTRACT

A device for holding coathangers in an item of luggage, the device comprising a support adapted for attachment to a wall of the item of luggage, a peg axially extending from a first end attached to the support to a second end and a cover attached to the support for selective rotational movement between an open position permitting coathanger hooks to be placed on and removed from the peg and a closed position substantially covering the peg and coathanger hooks thereon, the cover in the closed position cooperating with the peg to define a space enclosing the coathanger hooks.

11 Claims, 2 Drawing Sheets

DEVICE FOR HOLDING COATHANGERS IN AN ITEM OF LUGGAGE AND ITEM OF LUGGAGE EQUIPPED WITH SUCH A DEVICE

The present invention relates in general to an item of luggage and more specifically to a device fixed in such an item of luggage for holding coathangers.

The provision, in luggage, whether this be suitcases or suit carriers, of a device on which coathangers may be placed, said device possessing means for holding said coathangers in place as the luggage is moved is known.

At the present time, the devices for holding coathangers are usually designed in such a way that they will take only a specific shape of coathanger.

The user of the luggage therefore necessarily has to use the coathangers supplied with the luggage and cannot take an outfit from his closet and pack it directly into his luggage without changing the coathanger.

The object of the present invention is to alleviate this drawback by providing a device allowing the use of a great number of types of coathanger.

To this end, the invention provides a device for holding coathangers in an item of luggage, characterized in that it includes:

- a support by which it is fixed to a wall of the item of luggage,
- a central peg intended to carry the coathangers,
- a cover mounted so that it can move in rotation between a so-called open position for which it completely uncovers the central peg and a so-called closed position for which it mainly covers said central peg so as to form with said central peg a space closed by an upper, a lower and side walls.

The device according to the invention is also noteworthy in that:

- the central peg has a shank bounded at its ends by two protruding walls perpendicular to its axis and constituting a head and a base,
- the upper part of the wall of the shank is a portion of the cylinder with a large radius, said radius being similar to the internal radius of coathanger hooks,
- said cover consists of a wall bordered by two cheeks,
- the cover is mounted so that it can move in rotation about an axis parallel to the axis of the central peg and is situated outside the volume delimited by shank, the head and the base and inside the imaginary cylinder a portion of which forms the upper wall of the shank,
- it includes a pushbutton exhibiting a flat face interacting with a flat wall of the cover in order to lock the device in the closed position.
- said pushbutton is pushed by a spring back toward the position for which its flat face interacts with the flat face of the cover,
- the device is opened by a spring,
- the wall of said cover has an opening in which the ends of the coathanger hooks may be placed,
- the cover is returned to the closed position by a return spring.

The invention also relates to an item of luggage characterized in that it is equipped with a device for holding coathangers according to the invention.

The invention will be better understood by virtue of the description which will follow given by way of a non-limiting example with reference to the appended drawings in which.

Figure 1:
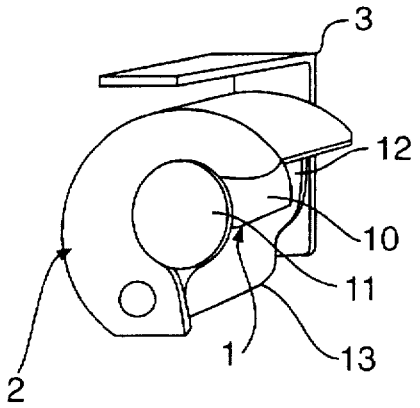
FIG. 1 is a perspective view of the device according to the invention in the closed position.
Figure 2:
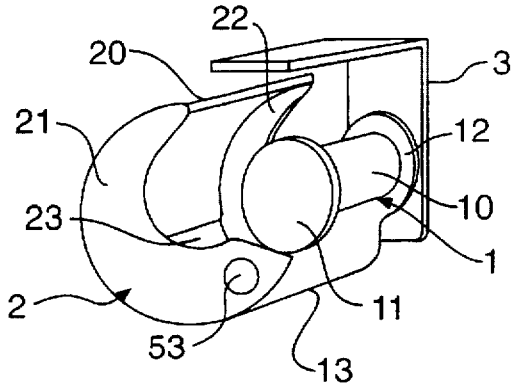
FIG. 2 is a perspective view of the device according to the invention in the open position.

As is visible in FIGS. 1 and 2, the device according to the invention consists overall of a central peg 1 and of a cover 2 which can move in rotation, both borne by a support 3.

The device according to the invention is fixed via the support 3 onto a W of the item of luggage which it is to equip.

The central peg 1 is intended to carry the coathangers.

This central peg 1 exhibits a shank 10 bound at its ends by two protruding walls perpendicular to its axis and constituting a head 11 and a base 12.

Figure 3:
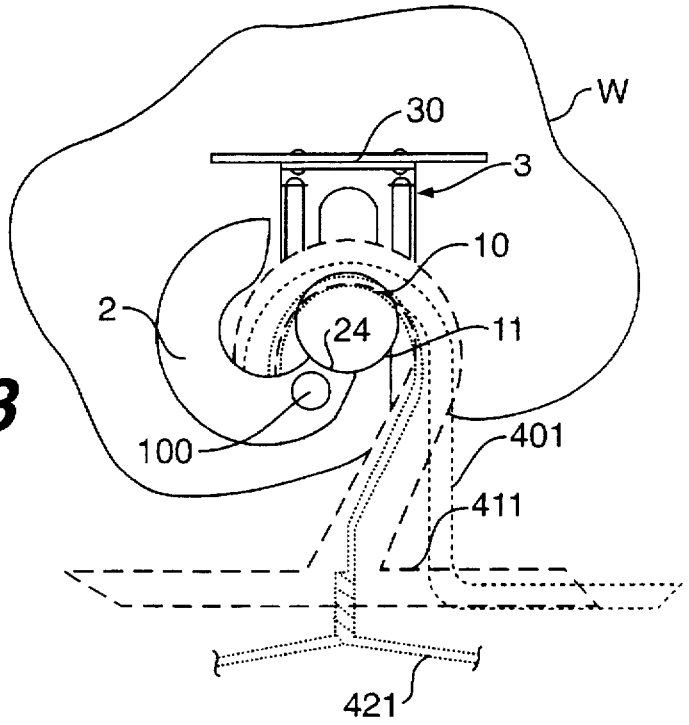
FIG. 3 is a front-on view showing the device according to the invention open, three different types of coathanger being positioned on said device.

As a preference, and as represented in dotted lines in FIG. 3, the upper part of the wall of the shank 10 is a portion of the cylinder with a large radius. This radius is chosen to be similar to the internal radius usually exhibited by the hooks of coathangers so as to give correct positioning thereof on the shank 10.

The base 12 of the central peg 1 bears against a wall of the support 3.

The cover 2 is constructed so that it forms, with the central peg, a space closed by an upper, a lower and side walls. To this end, said cover 2 consists of a wall 20 bordered by two cheeks 21 and 22.

As visible in the drawings, said cheeks 21 and 22 are, in the embodiment represented in the drawing, cut out so that they can be positioned around the head 11 and the base 12 of the central peg 1.

The cover 2 has substantially the size requirement of half a cylinder and is mounted so that it can move in rotation about an axis 100 parallel to the axis of the central peg 1 and is situated outside the volume delimited by the shank 10, the head 11 and the base 12.

This axis 100 is physically represented by a cylindrical housing 13 borne by the shank 10.

In the example represented in the drawing, this housing is positioned on the underside and slightly on the left of the shank 10.

Figure 4:
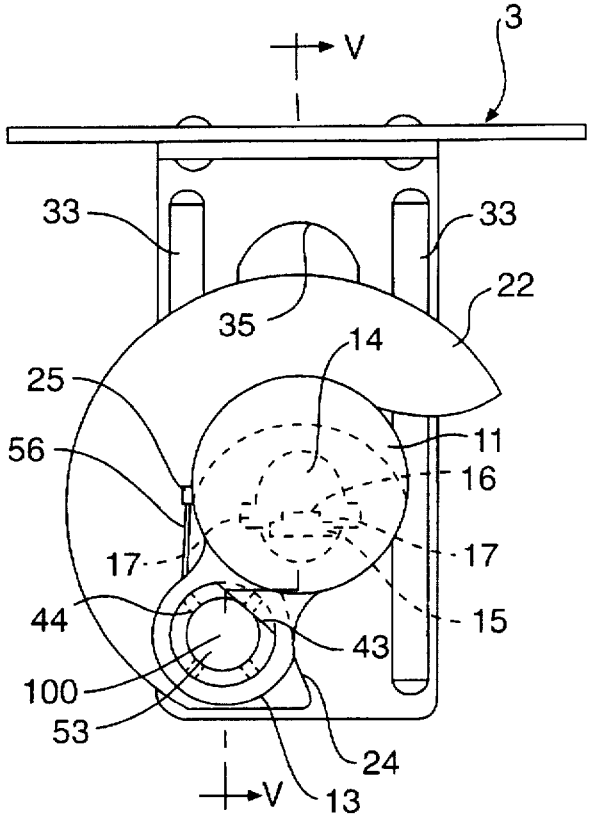
FIG. 4 is a front-on view of the device according to the invention in the closed position, with the cover partly cut away.

This arrangement makes it possible for said cover to be actuated between a so-called open position represented in FIGS. 2 and 3 for which it completely uncovers the central peg 1 and a so-called closed position represented in FIGS. 1 and 4 for which it mainly covers said central peg 1.

When the cover is in its open position, the hooks of the coathangers may easily be positioned over the shank 10 of the central peg, the end walls formed by the head 11 and the base 12 holding said hooks to prevent them from sliding axially and falling off. As represented in FIG. 3, coathangers as different as the coathangers 401, 411 and 421 may be positioned in the device according to the invention.

In the embodiment represented in the drawing, the open position of the cover is determined by a cut out 24 of said cover bearing against the head 11 of the central peg.

The wall 20 of said cover is cut out so that it exhibits an opening 23 in which the ends of the coathanger hooks may be placed.

As can be understood, the housing 13 embodying the axis 100 of rotation of the cover 2 must be arranged inside the imaginary cylinder one portion of which forms the upper wall of the shank 10 so that said housing does not impede the placing of the coathanger hooks.

When the cover 2 is folded into its closed position, the coathanger hooks are trapped in the housing formed by the central peg 1 and the cover 2 and cannot come out of this housing.

The bearing of the cheeks 21 and 22 of the cover 2 against the head 11 and the base 12 of the central peg 1 forms side walls of this housing limiting the sliding of said coathangers in the axial direction of the central peg 1.

As an alternative, the cover 2 could have a cheek 21 with a larger surface area which would be positioned against the head 11, on the outer side thereof.

A compressible elastic substance may be arranged inside the cover 2 or over the shank 10 of the central peg 1 so as to fix the positions of the coathangers in the device and thus prevent them from banging together.

Figure 5:
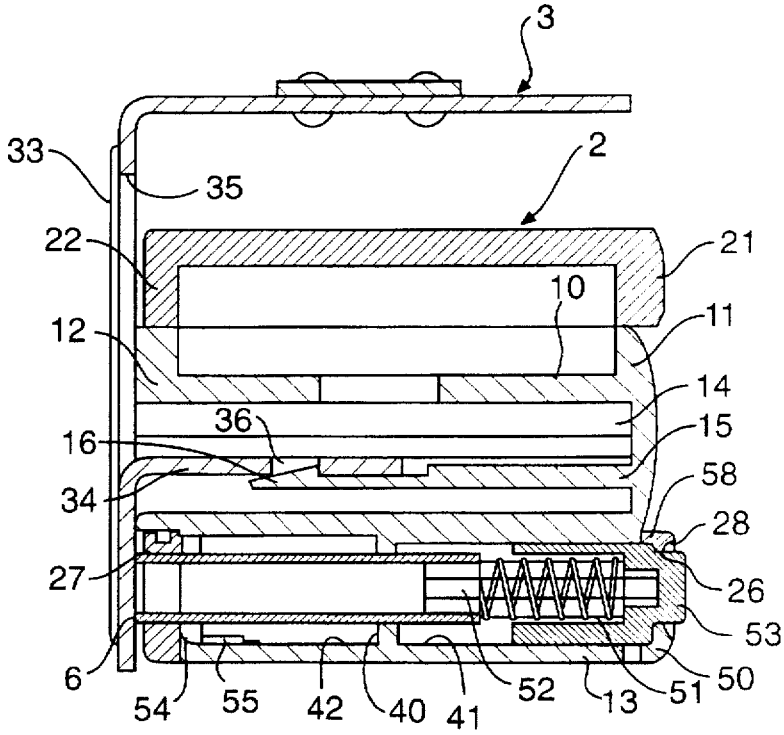
FIG. 5 is a section on V—V of FIG. 4.

FIG. 5 shows in more detail one embodiment of the device according to the invention.

The support 3 is made from a sheet, for example of metal, folded over at right angles and the vertical wall of which has stiffening ribs 33.

This support has a tab 34 folded over at right angles from an opening 35 formed in the vertical wall.

Said tab 34 has an aperture 36 located close to its free end passing through it.

A flexible tongue 15 ending in a boss 16 extends into the hollow internal space 14 of the shank 10.

Said hollow internal space 14 exhibits two slots 17.

The housing 13 of the central peg has a bore in two parts 41 and 42 separated by a wall 40 passing through it.

The bore 41 arranged toward the front of the device is not completely cylindrical and has a flap 43 visible in FIG. 4.

The bore 42 arranged toward the back of the device has four evenly spaced longitudinal ribs 44 on its periphery.

A pushbutton 50 of cylindrical overall shape and having a flat face 58 corresponding to the flap 43 is mounted so that it cannot rotate but can move in translation inside this bore 41.

This pushbutton 50 contains a return spring 51 mounted about a central rod 52, one of the ends of which is in contact with the internal face of the pushbutton, and the other end of which comes to bear against a hollow spacer piece 6 extending through an aperture 27 of the cheek 22 of the cover, the bore 42 and part of the bore 41.

The end of the pushbutton 50 is positioned in a shaping in the cheek 21 having a flat wall 28 intended to interact with the flat face 58 while the cylindrical head 53 of said pushbutton 50 extends into an aperture 26 in the cheek 21.

The interaction between the flat face 51 of the pushbutton 50 and the flat wall 28 of the cover locks the device in the closed position, the spring 51 pushes said pushbutton back toward this locked position.

Assembly is completed by a spring 54 which opens the cover 2, this spring is arranged in the bore 42 and has an axial tag 55 positioned between two ribs 44 of said bore and a radial tag 56 extending along the cheek 22 of the cover and fastened by its end into a notch 25 in said cheek 22.

The device represented in the drawing is assembled by positioning, on the one hand, the pushbutton equipped with the spring 51 in the bore 41 of the cylindrical housing 13 and, on the other hand, the spring 54 in the bore 42 with the radial tag 56 on the outside of the housing.

The cover 2 is positioned over the central peg 1 thus equipped with the apertures 26 and 27 of the cheeks 21 and 22 arranged respectively facing the bores 41 and 42 and the end of the radial arm 56 of the spring 54 is hooked into the notch 25.

The hollow spacer piece 6 is then placed inside the bore 42, inserting it through the aperture 27 of the cheek 22 of the cover. This spacer piece 6 acts via its end on the spring 51 which pushes the pushbutton 50 back until its head 53 is positioned in the aperture 26 of the cheek 21.

This assembly is fitted onto the support 3 by introducing the folded over tab 34 into the slots 17 until the boss 16 of the flexible tongue 15 becomes inserted in the aperture 36.

The operation of the device according to the invention will now be described.

With the device closed, the user presses on the head 53 of the pushbutton, and this moves the flat face 58 thereof away from the flat wall 28 of the cover. The spring 54 can then open the device by pushing the cover back in such a way that it rotates about the head 53 of the pushbutton 50 and about the hollow spacer piece 6 until the cutout 24 comes into abutment against the head 11.

When the user wishes to close the device again, he flaps the cover toward its closed position. When this position is reached, the flat face 58 of the pushbutton and the flat wall 28 of the cover are in line and the pushbutton is pushed back into its closed position by the spring 51.

What is claimed is:

1. A device for holding coathangers in an item of luggage, the device comprising:

a support adapted for attachment to a wall of the item of luggage;

a peg extending along a peg axis, the peg having a first end attached to the support, a second end axially spaced from the first end, and a shank defining the peg's surface between the first and second ends; and a cover pivotally attached to the support for movement about a cover axis between an open position permitting coathanger hooks to be placed on and removed from the peg and a closed position substantially covering the peg and coathanger hooks thereon, the cover in the closed position cooperating with the peg to define a space enclosing the coathanger hooks, the cover axis being parallel to the peg axis and radially spaced from the shank.

2. The device of claim 1 the peg comprises an axially extending shank and a pair of end walls extending perpendicularly to the axis of the shank, each end wall being fixed to a respective one of the first and second ends, the end walls and shank defining a peg volume.

3. The device of claim 2 wherein the shank defines a curved upper surface having a radius that is generally complementary to the inner radius of coathanger hooks.

4. The device of claim 3 wherein the cover comprises an annular wall bordered by two cheeks extending radially inward from the annular wall.

5. The device of claim 4 wherein the cover is attached to the support for rotation about the cover axis that is parallel to the axis of peg, that is located outside the peg volume, and that is located inside an imaginary cylinder a portion of which is defined by the upper surface of the shank.

6. The device of claim 2 wherein the cover comprises an annular wall bordered by two cheeks extending radially inward from the annular wall.

7. The device of claim 1 wherein the cover comprises a n annular wall bordered by two cheeks extending radially inward from the annular wall.

8. The device of claim 1 further comprising means for releasably locking the cover in the open position.

9. The device of claim 1 further comprising a button including a flat face disposed to engage a flat wall on the cover in the closed position to lock the device in the closed position.

10. The device of claim 9 wherein the button is spring-biased to the locked position and is manually releasable by pushing the button against the spring bias.

11. The device of claim 1 including a spring disposed to bias the cover to the open position.

* * * * *